US010062332B2

(12) United States Patent
Sengoku et al.

(10) Patent No.: US 10,062,332 B2
(45) Date of Patent: Aug. 28, 2018

(54) DISPLAY APPARATUS AND A METHOD OF DRIVING THE SAME

(71) Applicant: SAMSUNG DISPLAY CO., LTD., Yongin-si, Gyeonggi-do (KR)

(72) Inventors: Osamu Sengoku, Hwaseong-si (KR); Masami Igawa, Suwon-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 287 days.

(21) Appl. No.: 15/152,643

(22) Filed: May 12, 2016

(65) Prior Publication Data

US 2017/0069275 A1 Mar. 9, 2017

(30) Foreign Application Priority Data

Sep. 7, 2015 (KR) ..... 10-2015-0126307

(51) Int. Cl.
*G09G 3/34* (2006.01)
*G09G 3/36* (2006.01)

(52) U.S. Cl.
CPC ..... *G09G 3/3406* (2013.01); *G09G 3/3677* (2013.01); *G09G 3/3688* (2013.01); *G09G 2310/08* (2013.01); *G09G 2320/043* (2013.01); *G09G 2320/064* (2013.01)

(58) Field of Classification Search
CPC combination set(s) only.
See application file for complete search history.

(56) References Cited

U.S. PATENT DOCUMENTS 8,564,507 B2 10/2013 Jang et al.
2011/0141003 A1* 6/2011 Kim ..... G09G 3/342 345/102
2011/0157260 A1* 6/2011 Pyun ..... G02B 27/2264 345/691
2011/0279486 A1* 11/2011 Kang ..... G09G 3/3406 345/690
2012/0086740 A1* 4/2012 Murai ..... G09G 3/3406 345/690
2012/0147062 A1* 6/2012 Seo ..... G09G 3/342 345/690
2014/0184485 A1* 7/2014 Kim ..... G09G 3/3406 345/102

FOREIGN PATENT DOCUMENTS

JP 2010-257763 11/2010
JP 2012-088587 5/2012
JP 2012-169245 9/2012

* cited by examiner

*Primary Examiner* — Jennifer Mehmood
*Assistant Examiner* — Deeprose Subedi
(74) *Attorney, Agent, or Firm* — F. Chau & Associates, LLC

(57) ABSTRACT

A display apparatus includes a display panel including a plurality of pixels, wherein each of the pixels includes a switching element connected to a data line and a gate line, a light source configured to provide the display panel with a light, a light source driver configured to turn the light source on and off, and a panel driver configured to output a data voltage to the data lines and a gate signal to the gate lines during an ON period in which the light source turns on the light, and to block the data voltage to be applied to the data lines and the gate signal to be applied to the gate lines during an OFF period in which the light source turns off the light.

20 Claims, 6 Drawing Sheets

DISPLAY APPARATUS AND A METHOD OF DRIVING THE SAME

CROSS-REFERENCE TO RELATED APPLICATION

This application claims priority under 35 U.S.C. § 119 to Korean Patent Application No. 10-2015-0126307 filed on Sep. 7, 2015, the disclosure of which is incorporated by reference herein in its entirety.

TECHNICAL FIELD

Exemplary embodiments of the inventive concept relate to a display apparatus and a method of driving the display apparatus.

DESCRIPTION OF THE RELATED ART

Generally, a liquid crystal display (LCD) apparatus has a relatively small thickness, low weight and low power consumption. Thus, the LCD apparatus is used in monitors, laptop computers and cellular phones, etc. The LCD apparatus includes an LCD panel that displays images and a backlight assembly disposed under the LCD panel that provides light to the LCD panel. The LCD panel displays images using a selectively changeable light transmittance characteristic of liquid crystal. A driving circuit drives the LCD panel to selectively change the light transmittance characteristic of the liquid crystal.

The LCD panel includes an array substrate which has a plurality of gate lines, a plurality of data lines crossing the gate lines, a plurality of thin film transistors and a plurality of pixel electrodes corresponding to the thin film transistors. The liquid display panel also includes an opposing substrate which has a common electrode. A liquid crystal layer is interposed between the array substrate and opposing substrate.

The backlight assembly is disposed adjacent to the LCD panel and provides the LCD panel with a light. The backlight assembly includes a plurality of light emitting diodes. The backlight assembly turns on and turns off the plurality of light emitting diodes based on a light source driving signal.

The driving circuit includes a gate driver for driving the gate lines and a data driver for driving the data lines. The gate driver and the data driver drive the gate lines and the data lines of the LCD panel by a frame period.

When the light source driving signal is driven with a driving frequency different from that of the panel driving signal, the panel driving signal may include an interference noise. Display defects such as a waterfall defect may occur due to the interference noise.

SUMMARY

According to an exemplary embodiment of the inventive concept, there is provided a display apparatus. The display apparatus includes a display panel comprising a plurality of pixels, wherein each of the pixels comprises a switching element connected to a data line and a gate line, a light source configured to provide the display panel with a light, a light source driver configured to turn the light source on and off, and a panel driver configured to output a data voltage to the data lines and a gate signal to the gate lines during an ON period in which the light source turns on the light, and to block the data voltage to be applied to the data lines and the gate signal to be applied to the gate lines during an OFF period in which the light source turns off the light.

In an exemplary embodiment of the inventive concept, a driving frequency of a panel synchronization signal for driving the display panel may be substantially the same as a driving frequency of a light source driving signal for driving the light source.

In an exemplary embodiment of the inventive concept, an active period of a frame period in which the data voltage is applied to the data lines and the gate signal is applied to the gate lines, may be shorter than the ON period of the light source.

In an exemplary embodiment of the inventive concept, when a panel synchronization signal is at a first frequency lower than a second frequency, a light source driving signal has a duty ratio of about 50% and a frequency higher than the second frequency, and the panel driver is configured to output the data voltage and the gate signal during a period corresponding to the ON period and to block the data voltage and the gate signal during a period longer than the OFF period.

In an exemplary embodiment of the inventive concept, a driving frequency of a light source driving signal may be higher than a driving frequency of a panel synchronization signal.

In an exemplary embodiment of the inventive concept, the light source driving signal may have a cyclic section corresponding to n-horizontal periods, the ON period may be a first portion of the cyclic section and the OFF period may be a second portion of the cyclic section.

In an exemplary embodiment of the inventive concept, the panel driver may be configured to output the data voltage and the gate signal corresponding to the n-horizontal periods during the first portion of the cyclic section, and to block the data voltage and the gate signal during the second portion of the cyclic section.

In an exemplary embodiment of the inventive concept, the display apparatus may further include n-line buffers configured to store n-horizontal line data.

In an exemplary embodiment of the inventive concept, the light source may include at least one light emitting diode.

In an exemplary embodiment of the inventive concept, the light source driving signal may be a pulse width modulation signal.

According to an exemplary embodiment of the inventive concept, there is provided a method of driving a display apparatus which comprises outputting a data voltage to a data line and a gate signal to a gate line during an ON period in which a light source turns on a light, and blocking the data voltage to be applied to the data line and the gate signal to be applied to the gate line during an OFF period in which the light source turns off the light.

In an exemplary embodiment of the inventive concept, a driving frequency of a panel synchronization signal for driving a display panel may be substantially the same as a driving frequency of a light source driving signal for driving the light source.

In an exemplary embodiment of the inventive concept, an active period of a frame period in which the data voltage is applied to the data line and the gate signal is applied to the gate line, may be shorter than the ON period of the light source.

In an exemplary embodiment of the inventive concept, when a panel synchronization signal is at a first frequency lower than a second frequency, a light source driving signal may have a duty ratio of about 50% and a frequency higher than the second frequency, and the data voltage and the gate signal may be outputted during a period corresponding to the ON period and blocked during a period longer than the OFF period.

In an exemplary embodiment of the inventive concept, a driving frequency of a light source driving signal may be higher than a driving frequency of a panel synchronization signal.

In an exemplary embodiment of the inventive concept, the light source driving signal may have a cyclic section corresponding to n-horizontal periods, the ON period may be a first portion of the cyclic section and the OFF period may be a second portion of the cyclic section.

In an exemplary embodiment of the inventive concept, the data voltage and the gate signal corresponding to the n-horizontal periods may be outputted during the first portion of the cyclic section, and the data voltage and the gate signal may be blocked during the second portion of the cyclic section.

In an exemplary embodiment of the inventive concept, the method may further include storing n-horizontal line data in n-line buffers.

In an exemplary embodiment of the inventive concept, the light source may include at least one light emitting diode.

In an exemplary embodiment of the inventive concept, a pulse width modulation signal may be a driving signal of the light source.

According to an exemplary embodiment of the inventive concept, a display apparatus comprises: a display panel comprising a plurality of pixels, wherein each of the pixels comprises a transistor connected to a data line and a gate line; a light source configured to provide the display panel with a light; a light source driver configured to turn the light source on and off; and a panel driver configured to output a data voltage to all of the data lines and a gate signal to all the gate lines when the light source provides the light, and not output the data voltage to all of the data lines and the gate signal to all of the gate lines when the light source does not provide the light.

A pulse width modulation signal for driving the light source is on for the same amount of time the light source provides the light.

The light source provides the light for a shorter amount of time than an on period of a pulse width modulation signal for driving the light source.

BRIEF DESCRIPTION OF THE DRAWINGS

The above and other features of the inventive concept will become more apparent by describing in detail exemplary embodiments thereof with reference to the accompanying drawings, in which.

DETAILED DESCRIPTION OF THE EMBODIMENTS

Hereinafter, exemplary embodiments of the inventive concept will be explained in detail with reference to the accompanying drawings.

Figure 1:
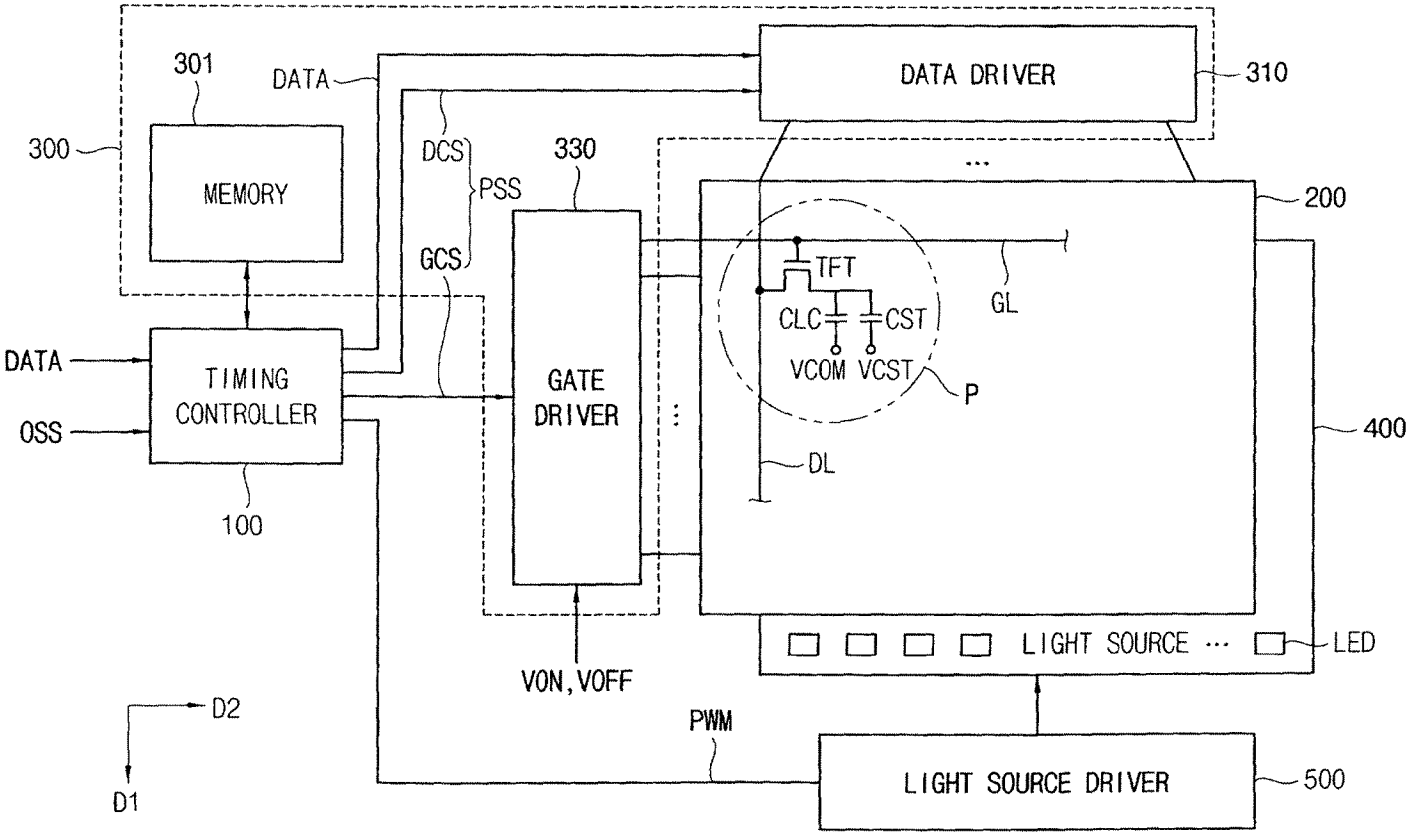
FIG. 1 is a block diagram illustrating a display apparatus according to an exemplary embodiment of the inventive concept.

FIG. 1 is a block diagram illustrating a display apparatus according to an exemplary embodiment of the inventive concept.

Referring to FIG. 1, the display apparatus may include a timing controller 100, a display panel 200, a panel driver 300, a light source 400 and a light source driver 500. The panel driver 300 may include a memory 301, a data driver 310 and a gate driver 330.

The timing controller 100 is configured to receive an original synchronization signal OSS and image data DATA from an external graphic processor. The timing controller 100 is configured to generate a panel synchronization signal PSS for driving the display panel 200, and a light source driving signal PWM for controlling a luminance of the light source 400 using the original synchronization signal OSS. The panel synchronization signal PSS may include a data control signal DCS for controlling the data driver 310 and a gate control signal GCS for controlling the gate driver 330. The data control signal DCS may include a vertical synchronization signal, a horizontal synchronization signal, a pixel clock signal, a data enable signal, a load signal, an inversion signal and so on. The gate control signal GCS may include a vertical start signal, a gate clock signal, an output enable signal and so on. In addition, the panel synchronization signal PSS may include a control signal for reading and writing the image data DATA in the memory 301.

The timing controller 100 may be configured to generate the light source driving signal PWM based on the panel synchronization signal PSS or, to generate the panel synchronization signal PSS based on the light source driving signal PWM.

The display panel 200 may include a plurality of data lines DL, a plurality of gate lines GL and a plurality of pixels P. The plurality of data lines DL extends in a first direction D1 and is arranged in a second direction D2 crossing the first direction D1. The plurality of gate lines GL extends in the second direction D2 and is arranged in the first direction D1. Each of the plurality of pixels P may include a switching element TFT, a liquid crystal capacitor CLC and a storage capacitor CST. The switching element TFT may be connected to a data line DL, a gate line GL and a first electrode of the liquid crystal capacitor CLC. A second electrode of the liquid crystal capacitor CLC may receive a common voltage VCOM. The storage capacitor CST includes a first electrode connected to the liquid crystal capacitor CLC. A second electrode of the storage capacitor CST may receive a storage voltage VCST.

The memory 301 is configured to store the image data DATA received from the external graphic processor based on the original synchronization signal OSS by a frame unit or a horizontal line unit based on the panel synchronization signal PSS. The memory 301 is further configured to readout the stored image data DATA based on the panel synchronization signal PSS.

The data driver 310 is configured to convert the image data DATA to a data voltage and, to output the data voltage to the data line DL of the display panel 200.

The gate driver 330 is configured to generate a gate signal having a gate-on voltage VON and a gate-off voltage OFF based on the gate control signal GCS and, to output the gate signal to the gate line GL of the display panel 200.

The light source 400 is configured to provide the display panel 200 with a light. The light source 400 may include at least one light emitting diode (LED).

The light source driver 500 is configured to generate a light source driving signal PWM having a driving frequency and a duty ratio which are controlled based on the light source driving signal PWM provided from the timing controller 100. The light source driving signal PWM may be a pulse width modulation signal. The light emitting diode LED of the light source 400 turns on the light during an ON period in which the light source driving signal PWM is at a high level and turns off the light during an OFF period in which the light source driving signal PWM is at a low level.

According to an exemplary embodiment of the inventive concept, a data voltage is charged in a pixel P of the display panel 200 during the ON period of the light source driving signal PWM and is not charged in the pixel P of the display panel 200 during the OFF period of the light source driving signal PWM. In other words, during the ON period of the light source driving signal PWM, the data driver 310 outputs the data voltage to the display panel 200 and the gate driver 330 outputs the gate signal to the display panel 200. However, during the OFF period of the light source driving signal PWM, the data driver 310 blocks the data voltage to be applied to the display panel 200 and the gate driver 330 blocks the gate signal to be applied to the display panel 200. Thus, during the OFF period of the light source driving signal PWM, the data driver 310 and the gate driver 330 are in a standstill condition.

According to an exemplary embodiment of the inventive concept, the data voltage is charged in all pixels P of the display panel 200 during the ON period of a frame period and is not charged in all of the pixels of the display panel 200 during the OFF period of the frame period. This way, a charge voltage difference between a first pixel charging a data voltage in the ON period and a second pixel charging a data voltage in the OFF period due to a light leakage current may be decreased and/or eliminated. Thus, display defects such as a waterfall defect may be decreased and/or eliminated.

Figure 2:
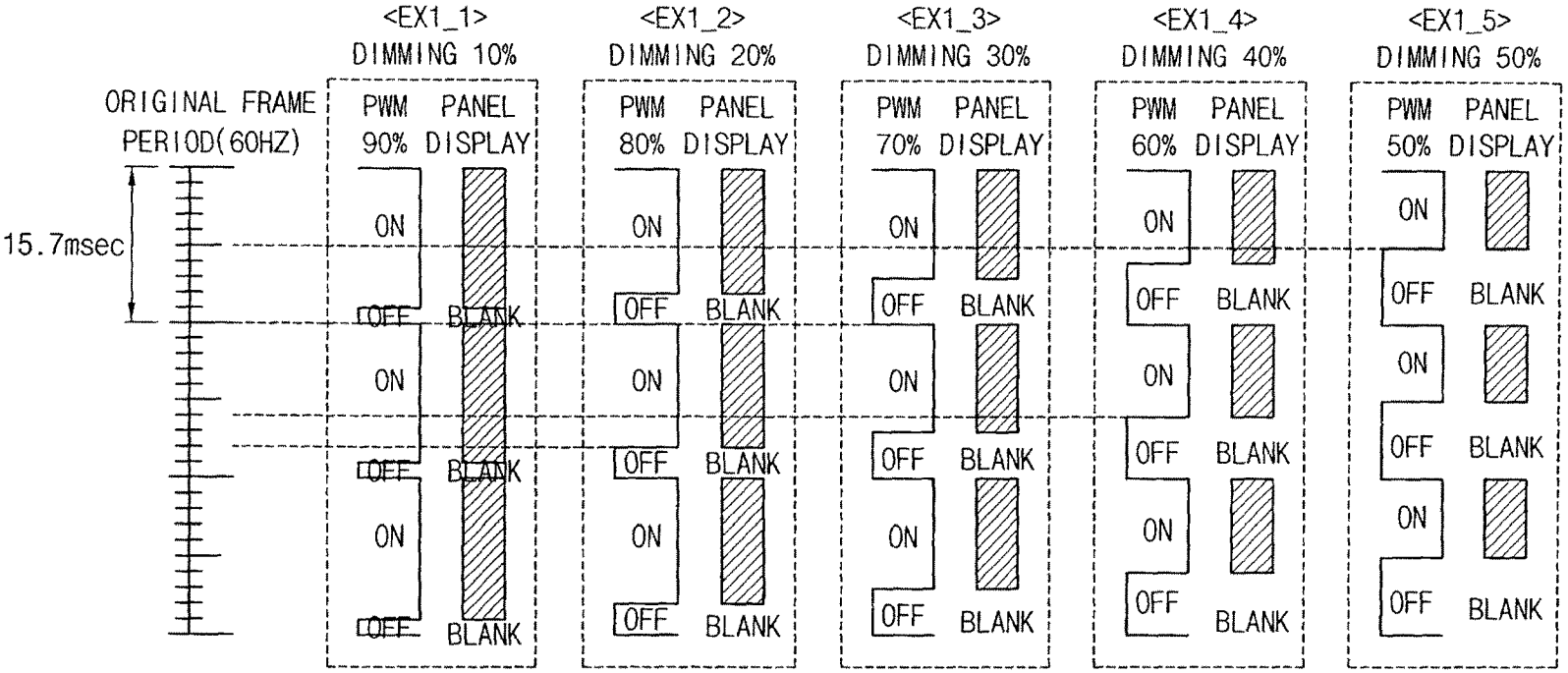
FIG. 2 is a diagram illustrating a method of driving a display apparatus according to an exemplary embodiment of the inventive concept.

FIG. 2 is a diagram illustrating a method of driving a display apparatus according to an exemplary embodiment of the inventive concept.

Referring to FIGS. 1 and 2, methods of driving a display panel 200 and a light source 400 according to various dimming modes are explained. The display panel 200 and the light source 400 may be driven with a driving frequency of about 60 Hz. For example, an original frame period of 60 Hz may be 15.7 msec.

EX1_1 illustrates the case of a 10% dimming mode. According to the exemplary embodiment of the inventive concept illustrated by EX1_1, a light source driver 500 is configured to provide the light source 400 with a light source driving signal PWM_90% having a duty ratio corresponding to about 90% of a frame period. Thus, during an ON period ON of the light source driving signal PWM_90%, the data driver 310 is configured to output a data voltage to the display panel 200 and the gate driver 330 is configured to output a gate signal to the display panel 200. Then, during an OFF period OFF of the light source driving signal PWM_90%, the data driver 310 is configured to block the data voltage to be applied to the display panel 200 and the gate driver 330 is configured to block the gate signal to be applied to the display panel 200. Therefore, all pixels P of the display panel 200 may charge the data voltage for about 90% of the frame period.

EX1_2 illustrates the case of a 20% dimming mode. According to the exemplary embodiment of the inventive concept illustrated by EX1_2, a light source driver 500 is configured to provide the light source 400 with a light source driving signal PWM_80% having a duty ratio corresponding to about 80% of a frame period. Thus, during an ON period ON of the light source driving signal PWM_80%, the data driver 310 is configured to output a data voltage to the display panel 200 and the gate driver 330 is configured to output a gate signal to the display panel 200. Then, during an OFF period OFF of the light source driving signal PWM_80%, the data driver 310 is configured to block the data voltage to be applied to the display panel 200 and the gate driver 330 is configured to block the gate signal to be applied to the display panel 200. Therefore, all pixels P of the display panel 200 may charge the data voltage for about 80% of the frame period.

EX1_3 illustrates the case of a 30% dimming mode. According to the exemplary embodiment of the inventive concept illustrated by EX1_3, a light source driver 500 is configured to provide the light source 400 with a light source driving signal PWM_70% having a duty ratio corresponding to about 70% of a frame period. Thus, during an ON period ON of the light source driving signal PWM_70%, the data driver 310 is configured to output a data voltage to the display panel 200 and the gate driver 330 is configured to output a gate signal to the display panel 200. Then, during an OFF period OFF of the light source driving signal PWM_70%, the data driver 310 is configured to block the data voltage to be applied to the display panel 200 and the gate driver 330 is configured to block the gate signal to be applied to the display panel 200. Therefore, all pixels P of the display panel 200 may charge the data voltage for about 70% of the frame period.

EX1_4 illustrates the case of a 40% dimming mode. According to the exemplary embodiment of the inventive concept illustrated by EX1_4, a light source driver 500 is configured to provide the light source 400 with a light source driving signal PWM_60% having a duty ratio corresponding to about 60% of a frame period. Thus, during an ON period ON of the light source driving signal PWM_60%, the data driver 310 is configured to output a data voltage to the display panel 200 and the gate driver 330 is configured to output a gate signal to the display panel 200. Then, during an OFF period OFF of the light source driving signal PWM_60%, the data driver 310 is configured to block the data voltage to be applied to the display panel 200 and the gate driver 330 is configured to block the gate signal to be applied to the display panel 200. Therefore, all pixels P of the display panel 200 may charge the data voltage for about 60% of the frame period.

EX1_5 illustrates the case of a 50% dimming mode. According to exemplary embodiment of the inventive concept illustrated by EX1_5, a light source driver 500 is configured to provide the light source 400 with a light source driving signal PWM_50% having a duty ratio corresponding to about 50% of a frame period. Thus, during an ON period ON of the light source driving signal PWM_50%, the data driver 310 is configured to output a data voltage to the display panel 200 and the gate driver 330 is configured to output a gate signal to the display panel 200. Then, during an OFF period OFF of the light source driving signal PWM_50%, the data driver 310 is configured to block the data voltage to be applied to the display panel 200 and the gate driver 330 is configured to block the gate signal to be applied to the display panel 200. Therefore, all pixels P of the display panel 200 may charge the data voltage for about 50% of the frame period.

In each of EX1_1, EX1_2, EX1_3, EX1_4 and EX1_5, when the PWM signal is OFF, the panel display is BLANK.

A light leakage current of the switching element TFT may occur during the ON period in which the light source 400 turns on the light. The light leakage current of the switching element TFT may not occur during the OFF period in the light source 400 turns off the light and a charge period in which the data voltage is applied to the pixel P.

For example, when a first pixel charges a data voltage during the ON period, the data voltage charged in the first pixel is dropped by the light leakage current during a first period except for a charge period of the first pixel and the OFF period in the frame period.

When a second pixel charges a data voltage during the OFF period, the data voltage charged in the second pixel is dropped by the light leakage current during a second period except for a charge period of the second pixel and the OFF period in the frame period. In this case, the charge period of the second pixel is included in the OFF period and thus, the second period is longer than the first period.

A voltage drop by the light leakage current may be defined by the following Equation.

Equation $$VLCD_C = VLCD_A - k \times (T_\text{Frame} - T_\text{Charge} - T_BL_\text{OFF})$$

$$VLCD_D = VLCD_A - k \times (T_\text{Frame} - T_BL_\text{OFF})$$

Wherein, 'k' is a slope corresponding to the light leakage current of the switching element TFT, 'T_Frame' is a frame period, 'T_Charge' is the charge period in which the data voltage is applied to the pixel and 'T_BL_OFF' is the OFF period of the light source 400. 'T_Charge' corresponds to a gate-on voltage period in which the switching element TFT turns on. 'VLCD_A' is a charge voltage charged in the pixel (e.g., the first or second pixel), 'VLCD_C' is a changed voltage of the first pixel which charges the data voltage in the ON period, and 'VLCD_D' is a changed voltage of the second pixel which charges the data voltage in the OFF period.

Therefore, a voltage drop of the changed voltage VLCD_D in the second pixel which charges the data voltage in the OFF period is larger than a voltage drop of the changed voltage VLCD_C in the first pixel which charges the data voltage in the ON period. As described above, a charge voltage difference between the first pixel charging a data voltage in the ON period and the second pixel charging a data voltage in the OFF period occurs due to the light leakage current, and thus, display defects such as a waterfall defect may occur.

According to an exemplary embodiment of the inventive concept, all pixels P of the display panel 200 charge the data voltage during the ON period in which the light source 400 turns on the light, and thus, charge voltages of all the pixels P have a uniform voltage drop due to the light leakage current. Therefore, display defects such as a waterfall defect may be decreased and/or eliminated.

Figure 3:
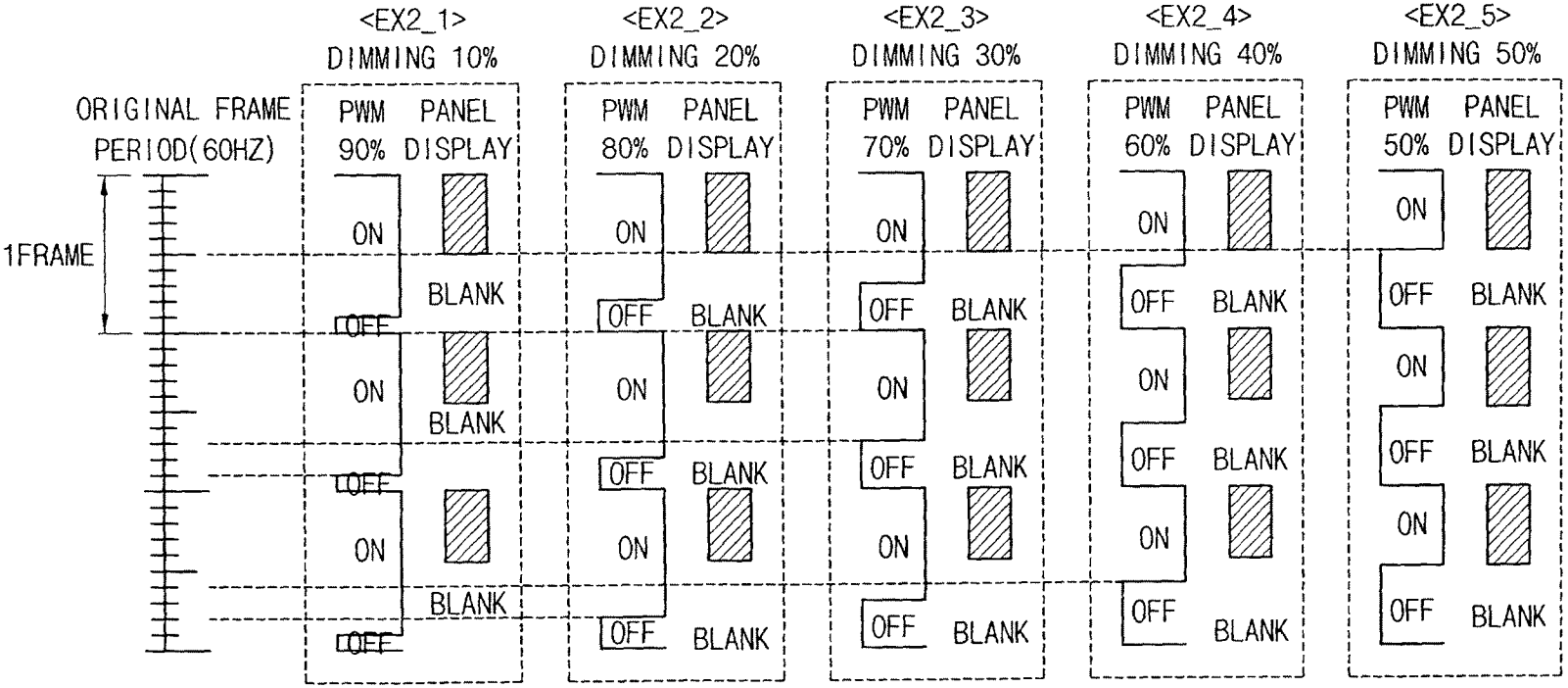
FIG. 3 is a diagram illustrating a method of driving a display apparatus according to an exemplary embodiment of the inventive concept.

FIG. 3 is a diagram illustrating a method of driving a display apparatus according to an exemplary embodiment of the inventive concept.

Referring to FIGS. 1 and 3, methods of driving a display panel 200 and a light source 400 according to various dimming modes are explained. The display panel 200 and the light source 400 may be driven with a driving frequency of about 60 Hz. For example, an original frame period may be driven at 60 Hz for 1 FRAME.

EX2_1 illustrates the case of a 10% dimming mode. According to the exemplary embodiment of the inventive concept illustrated by EX2_1, a light source driver 500 is configured to provide the light source 400 with a light source driving signal PWM_90% having a duty ratio corresponding to about 90% of a frame period. During a first ½ period of the frame period, the data driver 310 is configured to output a data voltage to the display panel 200 and the gate driver 330 is configured to output a gate signal to the display panel 200. The first ½ period of the frame period is included in an ON period ON of the light source driving signal PWM_90%. Then, during a second ½ period of the frame period, the data driver 310 is configured to block the data voltage to be applied to the display panel 200 and the gate driver 330 is configured to block the gate signal to be applied to the display panel 200. Therefore, all pixels P of the display panel 200 may charge the data voltage for about 50% of the frame period.

EX2_2 illustrates the case of a 20% dimming mode. According to the exemplary embodiment of the inventive concept illustrated by EX2_2, a light source driver 500 is configured to provide the light source 400 with a light source driving signal PWM_80% having a duty ratio corresponding to about 80% of a frame period. During a first ½ period of the frame period, the data driver 310 is configured to output a data voltage to the display panel 200 and the gate driver 330 is configured to output a gate signal to the display panel 200. The first ½ period of the frame period is included in an ON period ON of the light source driving signal PWM_80%. Then, during a second ½ period of the frame period, the data driver 310 is configured to block the data voltage to be applied to the display panel 200 and the gate driver 330 is configured to block the gate signal to be applied to the display panel 200. Therefore, all pixels P of the display panel 200 may charge the data voltage for about 50% of the frame period.

EX2_3 illustrates the case of a 30% dimming mode. According to the exemplary embodiment of the inventive concept illustrated by EX2_3, a light source driver 500 is configured to provide the light source 400 with a light source driving signal PWM_70% having a duty ratio corresponding to about 70% of a frame period. During a first ½ period of the frame period, the data driver 310 is configured to output a data voltage to the display panel 200 and the gate driver 330 is configured to output a gate signal to the display panel 200. The first ½ period of the frame period is included in an ON period ON of the light source driving signal PWM_70%. Then, during a second ½ period of the frame period, the data driver 310 is configured to block the data voltage to be applied to the display panel 200 and the gate driver 330 is configured to block the gate signal to be applied to the display panel 200. Therefore, all pixels P of the display panel 200 may charge the data voltage for about 50% of the frame period.

EX2_4 illustrates the case of a 40% dimming mode. According to the exemplary embodiment of the inventive concept illustrated by EX2_4, a light source driver 500 is configured to provide the light source 400 with a light source driving signal PWM_60% having a duty ratio corresponding to about 60% of a frame period. During a first ½ period of the frame period, the data driver 310 is configured to output a data voltage to the display panel 200 and the gate driver 330 is configured to output a gate signal to the display panel 200. The first ½ period of the frame period is included in an ON period ON of the light source driving signal PWM_60%. Then, during a second ½ period of the frame period, the data driver 310 is configured to block the data voltage to be applied to the display panel 200 and the gate driver 330 is configured to block the gate signal to be applied to the display panel 200. Therefore, all pixels P of the display panel 200 may charge the data voltage for about 50% of the frame period.

EX2_5 illustrates the case of a 50% dimming mode. According to the exemplary embodiment of the inventive concept illustrate by EX2_5, a light source driver 500 is configured to provide the light source 400 with a light source driving signal PWM_50% having a duty ratio corresponding to about 50% of a frame period. During a first ½ period of the frame period, the data driver 310 is configured to output a data voltage to the display panel 200 and the gate driver 330 is configured to output a gate signal to the display panel 200. The first ½ period of the frame period corresponds to an ON period ON of the light source driving signal PWM_50%. Then, during a second ½ period of the frame period, the data driver 310 is configured to block the data voltage to be applied to the display panel 200 and the gate driver 330 is configured to block the gate signal to be applied to the display panel 200. Therefore, all pixels P of the display panel 200 may charge the data voltage for about 50% of the frame period.

In each of EX2_1, EX2_2, EX2_3, EX2_4 and EX2_5 during the second ½ period of the frame period, the panel display is BLANK.

According to an exemplary embodiment of the inventive concept, all pixels P of the display panel 200 charge the data voltage during the ON period in which the light source 400 turns on the light, and thus, charge voltages charged in all of the pixels P have a uniform voltage drop due to the light leakage current. Therefore, a display defect such as a waterfall defect may be decreased and/or eliminated.

In addition, as compared with the exemplary embodiment of the inventive concept shown in FIG. 2, a standstill condition of the data driver 310 and the gate driver 330 may increase and thus, power consumption may decrease.

Figure 4:
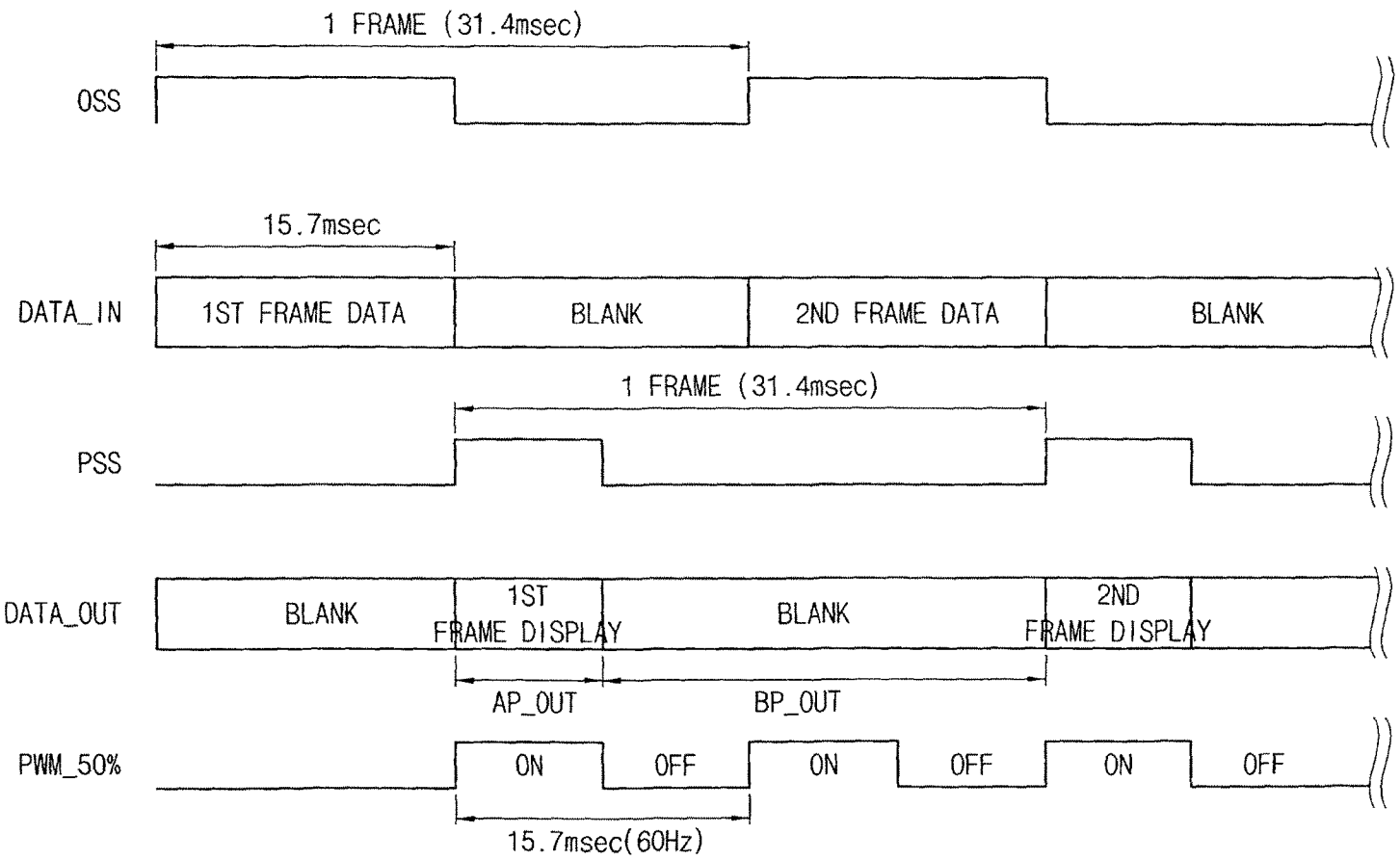
FIG. 4 is a waveform diagram illustrating a method of driving a display apparatus according to an exemplary embodiment of the inventive concept.

FIG. 4 is a waveform diagram illustrating a method of driving a display apparatus according to an exemplary embodiment of the inventive concept.

Referring to FIGS. 1 and 4, when a display panel is driven with a low frequency of about 30 Hz rather than a normal frequency of about 60 Hz, a method of driving a light source is explained in a 50% dimming mode.

The timing controller 100 is configured to generate a light source driving signal PWM_50% having a duty ratio of about 50% corresponding to the 50% dimming mode based on an original synchronization signal OSS of about 30 Hz received from an external graphic processor. In FIG. 4, data is input (DATA_IN) during a first half period of the original synchronization signal OSS (e.g., 1$^{st}$ FRAME DATA). Data may not be input during a second half period of original synchronization signal OSS (e.g., BLANK).

When the light source 400 is driven with the low frequency of about 30 Hz, a flicker defect may be observed. Thus, according to an exemplary embodiment of the inventive concept, the timing controller 100 is configured to generate the light source driving signal PWM_50% having a driving frequency of the normal frequency (e.g., about 60 Hz; 15.7 msec) and a duty ratio of about 50%.

The light source driving signal PWM_50% includes an ON period ON and an OFF period OFF which respectively corresponds to a ¼ period of a frame period of the original synchronization signal OSS of about 30 Hz (e.g., 31.4 msec).

However, the timing controller 100 is also configured to generate a panel synchronization signal PSS based on the light source driving signal PWM_50%. The panel synchronization signal PSS has a frequency of about 30 Hz (e.g., 31.4 msec).

The panel synchronization signal PSS includes an active period AP_OUT and a blanking period BP_OUT. The active period AP_OUT is a first ¼ period of a frame period of the original synchronization signal OSS which corresponds to the ON period ON of the light source driving signal PWM_50% and the blanking period BP_OUT is a next ¾ period of the frame period of the original synchronization signal OSS.

The timing controller 100 is configured to output the image data during the active period AP_OUT (DATA_OUT; 1$^{st}$ Frame Display) of the panel synchronization signal PSS. The data driver 310 and the gate driver 330 are configured to respectively output a data voltage and a gate signal during the active period AP_OUT of the panel synchronization signal PSS, and then, to be kept in a standstill condition during the blanking period BP_OUT of the synchronization signal PSS. Therefore, during the active period AP_OUT of the panel synchronization signal PSS, all pixels P of the display panel 200 charge the data voltage. As a consequence, the display panel 200 is driven with the driving frequency of about 60 Hz.

According to an exemplary embodiment of the inventive concept, all pixels P of the display panel 200 charge the data voltage during the ON period in which the light source 400 turns on the light, and thus, charge voltages charged in all of the pixels P have a uniform voltage drop due to the light leakage current. Therefore, a display defect such as a waterfall defect may be decreased and/or eliminated.

Figure 5:
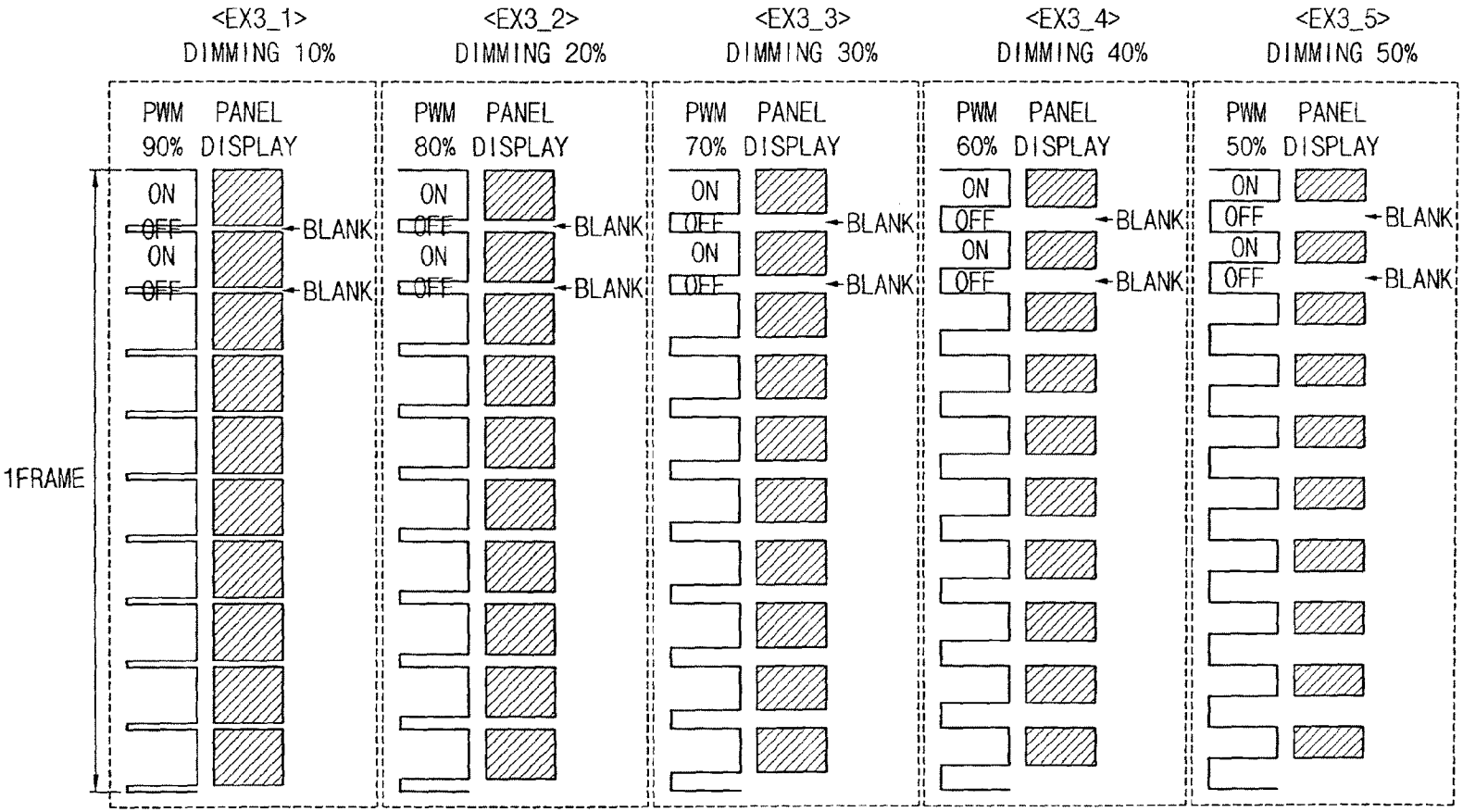
FIG. 5 is a diagram illustrating a method of driving a display apparatus according to an exemplary embodiment of the inventive concept.

FIG. 5 is a diagram illustrating a method of driving a display apparatus according to an exemplary embodiment of the inventive concept.

Referring to FIGS. 1 and 5, methods of driving a display panel 200 and a light source 400 according to various dimming modes are explained. The display panel 200 may be driven with a driving frequency of about 60 Hz and the light source 400 may be driven with a driving frequency of (K×60) Hz ('K' is a natural number) higher than a normal frequency of about 60 Hz.

EX3_1 illustrates the case of a 10% dimming mode. According to the exemplary embodiment of the inventive concept illustrated by EX3_1, the light source 400 is provided with a light source driving signal PWM_90% having a duty ratio of about 90% and a driving frequency of (K×60) Hz. The light source driving signal PWM_90% has a cyclic section corresponding to n horizontal periods (nH). The light source driving signal PWM_90% includes an ON period ON corresponding to 9/10 period of the cyclic section (nH) and an OFF period OFF corresponding to 1/10 period of the cyclic section (nH). During the ON period ON of the light source driving signal PWM_90%, the data driver 310 is configured to output data voltages of n horizontal lines and the gate driver 330 is configured to output gate signals corresponding to the n horizontal lines. Then, during the OFF period OFF of the light source driving signal PWM_90%, the data driver 310 is configured to block the data voltage to be applied to the display panel 200 and the gate driver 330 is configured to block the gate signal to be applied to the display panel 200. Therefore, all pixels P of the display panel 200 charge the data voltage for about 90% of the frame period and all of the pixels P of the display panel 200 do not charge the data voltage for about 10% of the frame period.

EX3_2 illustrates the case of a 20% dimming mode. According to the exemplary embodiment of the inventive concept illustrated by EX3_2, the light source 400 is provided with a light source driving signal PWM_80% having a duty ratio of about 80% and a driving frequency of (K×60) Hz. The light source driving signal PWM_80% has a cyclic section corresponding to n horizontal periods (nH). The light source driving signal PWM_80% includes an ON period ON corresponding to 8/10 period of the cyclic section (nH) and an OFF period OFF corresponding to 2/10 period of the cyclic section (nH). During the ON period ON of the light source driving signal PWM_80%, the data driver 310 is configured to output data voltages of n horizontal lines and the gate driver 330 is configured to output gate signals corresponding to the n horizontal lines. Then, during the OFF period OFF of the light source driving signal PWM_80%, the data driver 310 is configured to block the data voltage to be applied to the display panel 200 and the gate driver 330 is configured to block the gate signal to be applied to the display panel 200. Therefore, all pixels P of the display panel 200 charge the data voltage for about 80% of the frame period and all of the pixels P of the display panel 200 do not charge the data voltage for about 20% of the frame period.

EX3_3 illustrates the case of a 30% dimming mode. According to the exemplary embodiment of the inventive concept illustrated by EX3_3, the light source 400 is provided with a light source driving signal PWM_70% having a duty ratio of about 70% and a driving frequency of (K×60) Hz. The light source driving signal PWM_70% has a cyclic section corresponding to n horizontal periods (nH). The light source driving signal PWM_70% includes an ON period ON corresponding to 7/10 period of the cyclic section (nH) and an OFF period OFF corresponding to 3/10 period of the cyclic section (nH). During the ON period ON of the light source driving signal PWM_70%, the data driver 310 is configured to output data voltages of n horizontal lines and the gate driver 330 is configured to output gate signals corresponding to the n horizontal lines. Then, during the OFF period OFF of the light source driving signal PWM_70%, the data driver 310 is configured to block the data voltage to be applied to the display panel 200 and the gate driver 330 is configured to block the gate signal to be applied to the display panel 200. Therefore, all pixels P of the display panel 200 charge the data voltage for about 70% of the frame period and all of the pixels P of the display panel 200 do not charge the data voltage for about 30% of the frame period.

EX3_4 illustrates the case of a 40% dimming mode. According to the exemplary embodiment of the inventive concept illustrated by EX3_4, the light source 400 is provided with a light source driving signal PWM_60% having a duty ratio of about 60% and a driving frequency of (K×60) Hz. The light source driving signal PWM_60% has a cyclic section corresponding to n horizontal periods (nH). The light source driving signal PWM_60% includes an ON period ON corresponding to 6/10 period of the cyclic section (nH) and an OFF period OFF corresponding to 4/10 period of the cyclic section (nH). During the ON period ON of the light source driving signal PWM_60%, the data driver 310 is configured to output data voltages of n horizontal lines and the gate driver 330 is configured to output gate signals corresponding to the n horizontal lines. Then, during the OFF period OFF of the light source driving signal PWM_60%, the data driver 310 is configured to block the data voltage to be applied to the display panel 200 and the gate driver 330 is configured to block the gate signal to be applied to the display panel 200. Therefore, all pixels P of the display panel 200 charge the data voltage for about 60% of the frame period and all of the pixels P of the display panel 200 do not charge the data voltage for about 40% of the frame period.

EX3_5 illustrates the case of a 50% dimming mode. According to the exemplary embodiment of the inventive concept illustrated by EX3_5, the light source 400 is provided with a light source driving signal PWM_50% having a duty ratio of about 50% and a driving frequency of (K×60) Hz. The light source driving signal PWM_50% has a cyclic section corresponding to n horizontal periods (nH). The light source driving signal PWM_50% includes an ON period ON corresponding to 5/10 period of the cyclic section (nH) and an OFF period OFF corresponding to 5/10 period of the cyclic section (nH). During the ON period ON of the light source driving signal PWM_50%, the data driver 310 is configured to output data voltages of n horizontal lines and the gate driver 330 is configured to output gate signals corresponding to the n horizontal lines. Then, during the OFF period OFF of the light source driving signal PWM_50%, the data driver 310 is configured to block the data voltage to be applied to the display panel 200 and the gate driver 330 is configured to block the gate signal to be applied to the display panel 200. Therefore, all pixels P of the display panel 200 charge the data voltage for about 50% of the frame period and all of the pixels P of the display panel 200 do not charge the data voltage for about 50% of the frame period.

According to an exemplary embodiment of the inventive concept, all pixels P of the display panel 200 charge the data voltage during the ON period in which the light source 400 turns on the light, and thus, charge voltages charged in all of the pixels P have a uniform voltage drop due to the light leakage current. Therefore, a display defect such as a waterfall defect may be decreased and/or eliminated.

Figure 6:
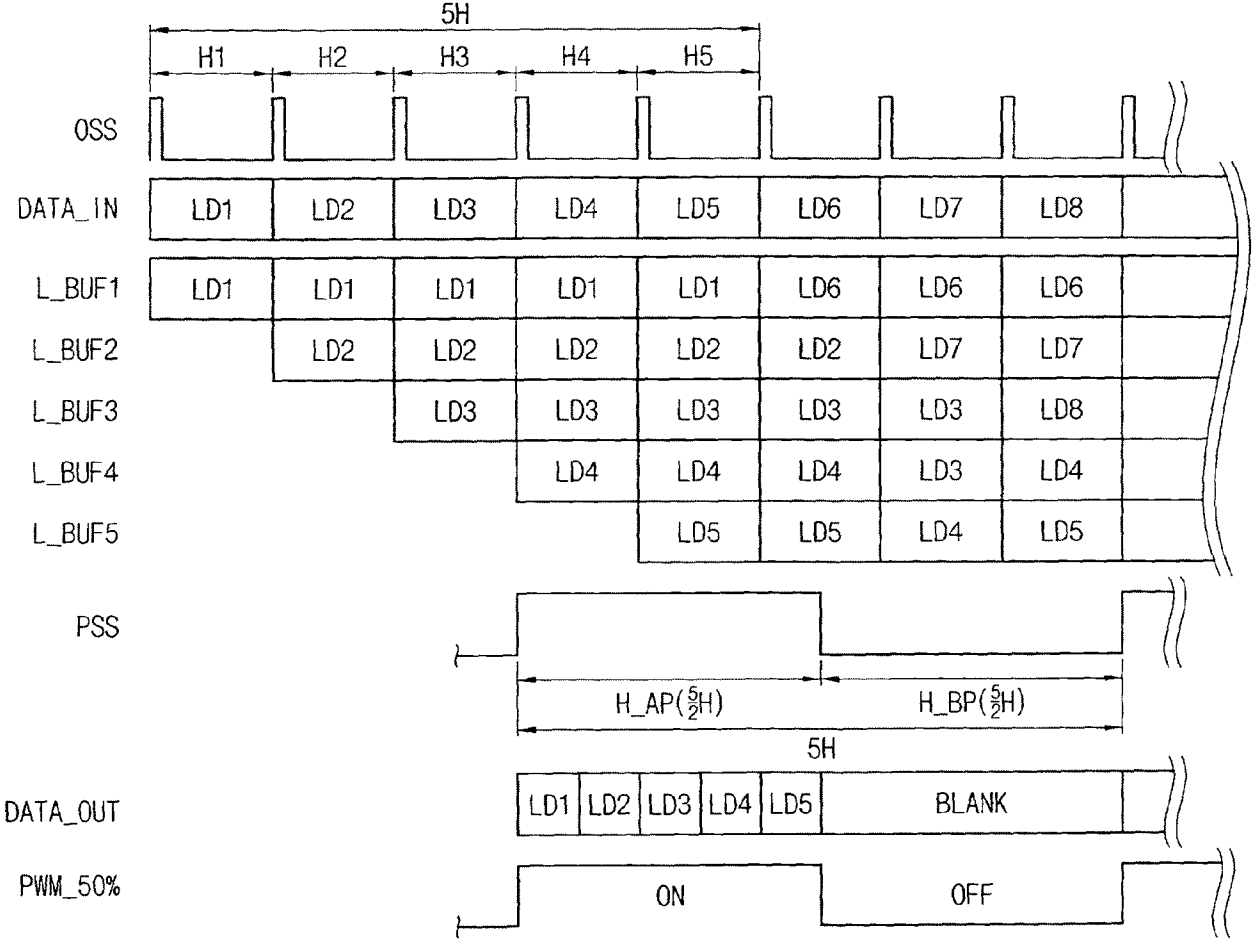
FIG. 6 is a waveform diagram illustrating a method of driving a display apparatus according to an exemplary embodiment of the inventive concept.

FIG. 6 is a waveform diagram illustrating a method of driving a display apparatus according to an exemplary embodiment of the inventive concept.

Referring to FIGS. 1 and 6, a light source is driven using a light source driving signal PWM_50% that has a cyclic section corresponding to 5 horizontal periods (5H) in a 50% dimming mode. Under this condition, a method of driving a display panel is explained.

The timing controller 100 is configured to sequentially store first to fifth horizontal line data LD1, LD2, LD3, LD4 and LD5 (DATA_IN) received from an external graphic processor in at least five line buffers L_BUF1, L_BUF2, L_BUF3, L_BUF4 and L_BUF5 based on an original synchronization signal OSS. In a next 5 horizontal periods, sixth to tenth horizontal line data LD6, LD7, LD8 . . . LD10 are stored in the five line buffers L_BUF1, L_BUF2, L_BUF3, L_BUF4 and L_BUF5. For example, the first horizontal line data LD1 are stored in a first line buffer L_BUF1 during a first horizontal period H1, the second horizontal line data LD2 are stored in a second line buffer L_BUF2 during a second horizontal period H2, the third horizontal line data LD3 are stored in a third line buffer L_BUF3 during a third horizontal period H3, the fourth horizontal line data LD4 are stored in a fourth line buffer L_BUF4 during a fourth horizontal period H4 and the fifth horizontal line data LD5 are stored in a fifth line buffer L_BUF5 during a fifth horizontal period H5.

The timing controller 100 is configured to generate a panel synchronization signal PSS based on the original synchronization signal OSS. The panel synchronization signal PSS has a cyclic section corresponding to five horizontal periods (5H) and includes a horizontal active period H_AP and a horizontal blanking period H_BP. The horizontal active period H_AP corresponds to a first ½ period of the cyclic section (5H) and the horizontal blanking period H_BP corresponds to a second ½ period of the cyclic section (5H).

The timing controller 100 is configured to readout the first to fifth horizontal line data LD1, LD2, LD3, LD4 and LD5 in the first to fifth line buffers L_BUF1, L_BUF2, L_BUF3, L_BUF4 and L_BUF5, and to output the first to fifth horizontal line data LD1, LD2, LD3, LD4 and LD5 to the display panel 200 based on the panel synchronization signal PSS (DATA_OUT).

For example, the timing controller 100 is configured to control the data driver 310 and the gate driver 330 based on the panel synchronization signal PSS such that the first to fifth horizontal line data LD1, LD2, LD3, LD4 and LD5 are applied to the first to fifth horizontal lines of the display panel 200 during the horizontal active period H_AP of the panel synchronization signal PSS and the first to fifth horizontal line data LD1, LD2, LD3, LD4 and LD5 are not applied to the first to fifth horizontal lines of the display panel 200 during the horizontal blanking period H_BP of the panel synchronization signal PSS.

Therefore, during the horizontal active period H_AP of the panel synchronization signal PSS, the data driver 310 and the gate driver 330 are configured to respectively output data voltages and gate signals corresponding to the first to fifth horizontal line data LD1, LD2, LD3, LD4 and LD5, and then, during the horizontal blanking period H_BP of the panel synchronization signal PSS, the data driver 310 and the gate driver 330 are driven in the standstill condition.

However, the timing controller 100 is configured to generate a light source driving signal PWM_50% having a duty ratio of about 50% based on the panel synchronization signal PSS. The light source driving signal PWM_50% includes an ON period ON corresponding to the horizontal active period H_AP and an OFF period OFF corresponding to the horizontal blanking period H_BP.

As described above, the display panel 200 and the light source 400 are driven.

Therefore, the data voltages are applied to all pixels P of the display panel 200 for about 50% of the frame period and the data voltages are not applied to all of the pixels of the display panel 200 for about 50% of the frame period.

According to an exemplary embodiment of the inventive concept, all pixels P of the display panel 200 charge the data voltage during the ON period in which the light source 400 turns on the light, and thus, charge voltages charged in all of the pixels P have a uniform voltage drop due to the light leakage current. Therefore, a display defect such as a waterfall defect may be decreased and/or eliminated.

While the inventive concept has been particularly shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. A display apparatus, comprising:

a display panel comprising a plurality of pixels, wherein each of the pixels comprises a switching element connected to a data line and a gate line;

a light source configured to provide the display panel with a light;

a light source driver configured to turn the light source on and off; and a panel driver configured to output a data voltage to the data lines and a gate signal to the gate lines during an ON period in which the light source turns on the light, and to block the data voltage to be applied to the data lines and the gate signal to be applied to the gate lines during an OFF period in which the light source turns off the light.

2. The display apparatus of claim 1, wherein a driving frequency of a panel synchronization signal for driving the display panel is substantially the same as a driving frequency of a light source driving signal for driving the light source.

3. The display apparatus of claim 1, wherein an active period of a frame period in which the data voltage is applied to the data lines and the gate signal is applied to the gate lines, is shorter than the ON period of the light source.

4. The display apparatus of claim 1, wherein when a panel synchronization signal is at a first frequency lower than a second frequency, a light source driving signal has a duty ratio of about 50% and a frequency higher than the second frequency, and the panel driver is configured to output the data voltage and the gate signal during a period corresponding to the ON period and to block the data voltage and the gate signal during a period longer than the OFF period.

5. The display apparatus of claim 1, wherein a driving frequency of a light source driving signal is higher than a driving frequency of a panel synchronization signal.

6. The display apparatus of claim 5, wherein the light source driving signal has a cyclic section corresponding to n-horizontal periods, the ON period is a first portion of the cyclic section and the OFF period is a second portion of the cyclic section.

7. The display apparatus of claim 6, wherein the panel driver is configured to output the data voltage and the gate signal corresponding to the n-horizontal periods during the first portion of the cyclic section, and to block the data voltage and the gate signal during the second portion of the cyclic section.

8. The display apparatus of claim 5, further comprising:

n-line buffers configured to store n-horizontal line data.

9. The display apparatus of claim 1, wherein the light source comprises at least one light emitting diode.

10. The display apparatus of claim 9, wherein the light source driving signal is a pulse width modulation signal.

11. A method of driving a display apparatus, comprising:

outputting a data voltage to a data line and a gate signal to a gate line during an ON period in which a light source turns on a light; and blocking the data voltage to be applied to the data line and the gate signal to be applied to the gate line during an OFF period in which the light source turns off the light.

12. The method of claim 11, wherein a driving frequency of a panel synchronization signal for driving a display panel is substantially the same as a driving frequency of a light source driving signal for driving the light source.

13. The method of claim 11, wherein an active period of a frame period in which the data voltage is applied to the data line and the gate signal is applied to the gate line, is shorter than the ON period of the light source.

14. The method of claim 11, wherein when a panel synchronization signal is at a first frequency lower than a second frequency, a light source driving signal has a duty ratio of about 50% and a frequency higher than the second frequency, and the data voltage and the gate signal are outputted during a period corresponding to the ON period and blocked during a period longer than the OFF period.

15. The method of claim 11, wherein a driving frequency of a light source driving signal is higher than a driving frequency of a panel synchronization signal.

16. The method of claim 15, wherein the light source driving signal has a cyclic section corresponding to n-horizontal periods, the ON period is a first portion of the cyclic section and the OFF period is a second portion of the cyclic section.

17. The method of claim 16, wherein the data voltage and the gate signal corresponding to the n-horizontal periods are outputted the during the first portion of the cyclic section, and the data voltage and the gate signal are blocked during the second portion of the cyclic section.

18. The method of claim 15, further comprising:

storing n-horizontal line data in n-line buffers.

19. The method of claim 11, wherein the light source comprises at least one light emitting diode.

20. The method of claim 19, wherein a pulse width modulation signal is a driving signal of the light source.

* * * * *